US006520363B1

(12) United States Patent
Sullivan

(10) Patent No.: US 6,520,363 B1
(45) Date of Patent: Feb. 18, 2003

(54) TEMPORARY PROTECTIVE COVER FOR ELECTRICAL OUTLET RECEPTACLE

(76) Inventor: Joseph Sullivan, 7 Crossfield Rd., Forrestdale, MA (US) 02644

( * ) Notice: Subject to any disclaimer, the term of this patent is extended or adjusted under 35 U.S.C. 154(b) by 0 days.

(21) Appl. No.: 09/943,455

(22) Filed: Aug. 30, 2001

(51) Int. Cl.[7] ..... B26F 1/24

(52) U.S. Cl. ..... 220/3.8; 220/241; 174/66; 33/DIG. 10; 30/366

(58) Field of Search ..... 220/3.8, 241, 242, 220/3.3; 33/DIG. 10; 30/366; 174/66, 67

(56) References Cited

U.S. PATENT DOCUMENTS 3,015,408 A * 1/1962 Campbell et al. ..... 220/3.8
3,424,332 A * 1/1969 Pimentel ..... 174/58
3,888,013 A * 6/1975 Benoit ..... 33/DIG. 10
3,924,331 A * 12/1975 Goosen ..... 30/366
4,259,785 A * 4/1981 Wortham ..... 30/366
4,953,733 A * 9/1990 Loscuito ..... 220/3.8
5,301,437 A * 4/1994 Burke ..... 33/DIG. 10
D361,059 S * 8/1995 De Waal ..... D13/177
5,526,952 A * 6/1996 Green ..... 220/3.8
5,562,222 A * 10/1996 Jordan et al. ..... 220/3.8
5,835,980 A * 11/1998 Houssian ..... 220/3.8

* cited by examiner

*Primary Examiner*—Nathan J. Newhouse
(74) *Attorney, Agent, or Firm*—Morse, Altman & Martin

(57) ABSTRACT

An electrical receptacle shield in the form of a thin sheet metal stamping for temporarily covering the front opening of a utility receptacle. The receptacle has free front edges that define a front profile having an inner perimeter. The shield has an outer peripheral section in an anterior plane, an inner section in a posterior plane, and an intermediate section that slopes between the inner section and the peripheral section. The peripheral and intermediate sections have a plurality of gaps with a plurality of catches extend outwardly through the gaps. The catches extend outwardly to the inner perimeter of the front edges. The shield is pressed into the receptacle opening, held in position by the catches, and pried out when no longer needed.

4 Claims, 6 Drawing Sheets

TEMPORARY PROTECTIVE COVER FOR ELECTRICAL OUTLET RECEPTACLE

CROSS-REFERENCES TO RELATED APPLICATIONS

Not Applicable.

Statement Regarding Federally Sponsored Research or Development

Not Applicable.

BACKGROUND OF THE INVENTION

1. Field of the Invention

The present invention relates to the protection of electrical outlet receptacles during installation, and, more particularly, to temporary shields for protecting the contents of electrical outlet receptacles during installation. Typically, an outlet receptacle initially is nailed or otherwise affixed to a wall stud while exposed. Then sheet rock or other drywall is nailed to the wall stud in front of the outlet receptacle. An opening then is cut into the drywall to expose the front of the receptacle.

2. Description of the Related Art

Determining the proper location of the opening in front of the outlet receptacle has been a problem. As previously stated, outlet receptacles are nailed or otherwise secured to wall support studs and are wired before a drywall or the like is nailed or stapled to the support studs. An outlet receptacle then is located by tapping or punching the drywall, after which an opening that matches the outlet receptacle is cut with a hand-held router or utility knife using the outlet receptacle as a guide. Damage to the electrical wiring within the outlet receptacle often occurs. A variety of prior art shields have been proposed to protect the contents of outlet receptacles during the construction process. Such shields in the past typically have been inconvenient to carry and unwieldy to use because of their unnecessarily rugged and complex construction. Furthermore, their complex construction often has hindered rather than helped cutting an appropriate opening in an associated drywall. There is a need for a simplified, lightweight and inexpensive outlet shield that can be readily located behind a dry wall and that can be used effectively as a guide for cutting an opening that matches the outlet receptacle.

BRIEF SUMMARY OF THE INVENTION

The primary object of the present invention is to provide an electrical receptacle shield in the form of a thin sheet metal stamping, a supply of which may be readily stacked and carried. This shield is designed to temporarily but effectively cover the front opening of an outlet receptacle that is characterized by a back wall and a peripheral wall bounding the back wall and the front opening. The peripheral wall has free front edges of predetermined thickness, which may be considered to lie in a plane and to define a front rim having an outer perimeter and an inner perimeter. The peripheral wall has a plurality of inwardly directed ridges having foreword faces that lie in the plane of the rim of the peripheral wall. These ridges have tapped holes for the reception of screws by which a finish plate may be secured to the outlet receptacle after its front opening is exposed through the drywall.

A precise geometrical description of the shield is necessary for an understanding of the present invention.

Specifically, the shield is in the form of a tray that has an outer rim section lying in an anterior plane, an inner base section lying in a posterior plane, and an intermediate slope section that extends between the inner base section and the outer rim section. The front profile of the rim section surrounds the front profile of the slope section. The front profile of the slope section surrounds the front profile of the base section. The rim section and the slope section have a plurality of gaps. A plurality of catches extend outwardly from the base section through the gaps. The free extremities of the catches extend outwardly at least to the inner perimeter of the front profile of the rim section. The arrangement is such that the shield can be pressed into the front opening of the outlet receptacle, held in position by the catches, which clutch the receptacle's interior walls, and can be pried from the receptacle after use by a screw driver for replacement by a finish plate.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
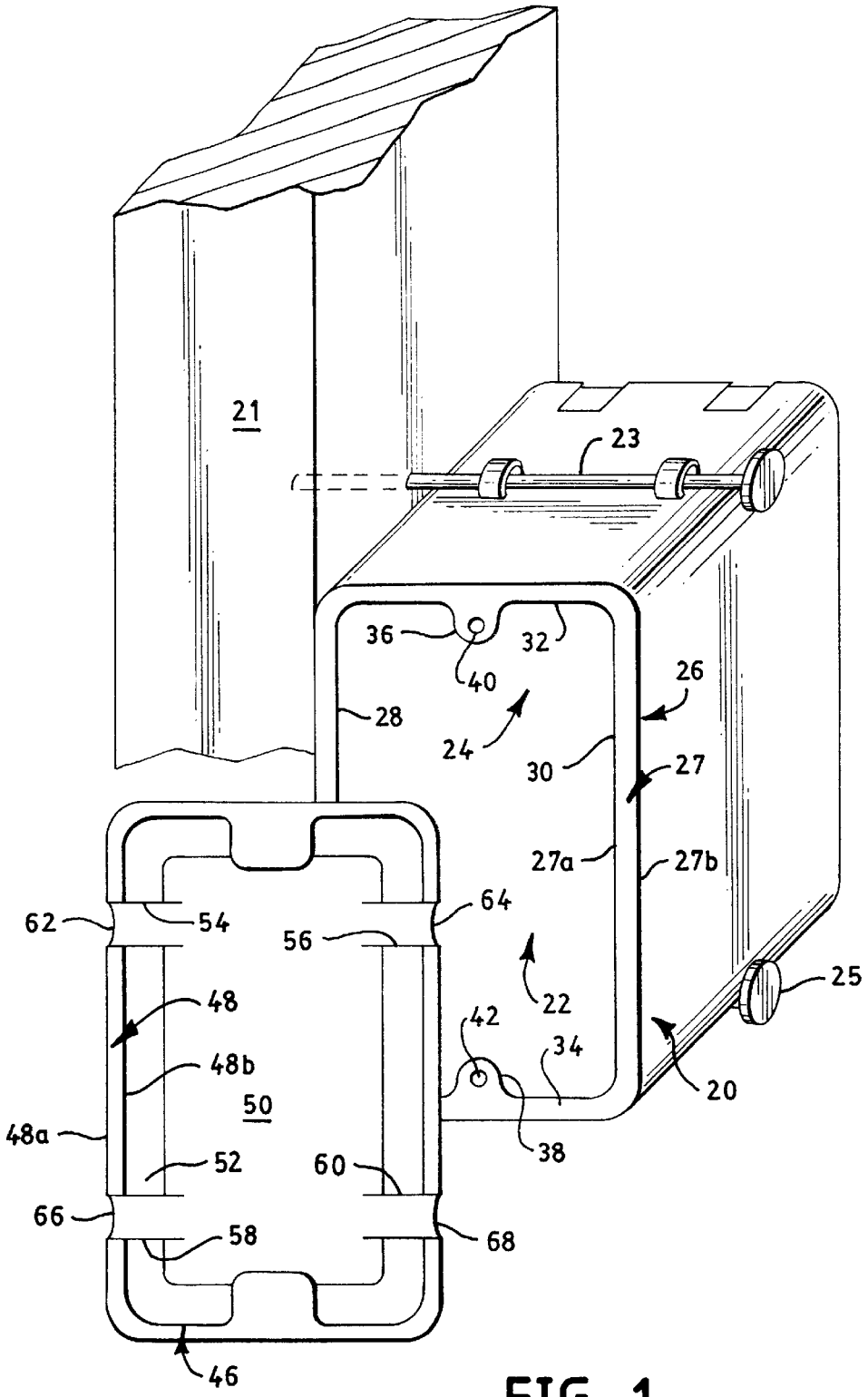
FIG. 1 is an exploded perspective view showing a front plan view of a shield of the present invention and the relationship between the shield and an electrical outlet receptacle in accordance with the present invention.
Figure 2:
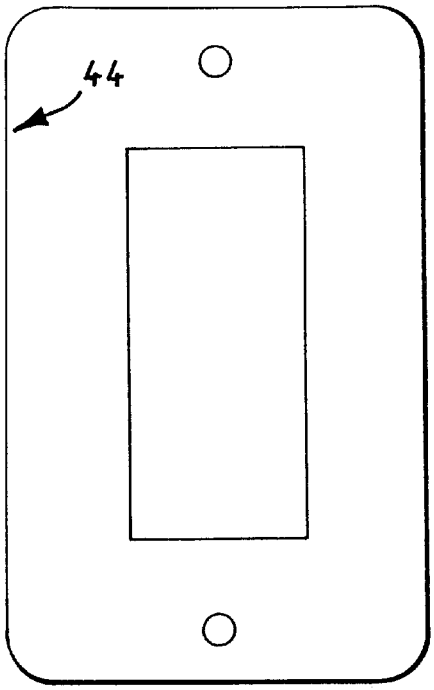
FIG. 2 shows a finish plate for replacement of the shield after a registered opening in a dry wall has been cut and installation has been completed.
Figure 3:
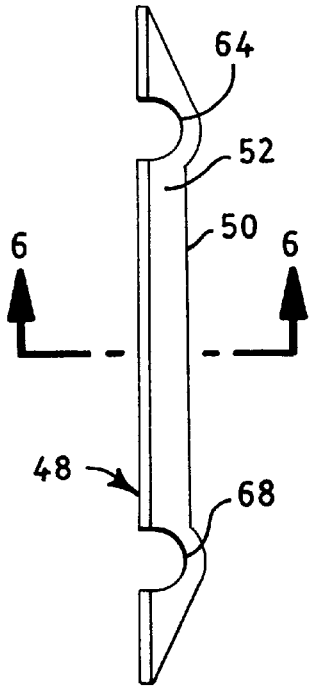
FIG. 3 is a side view of the shield of FIG. 1.
Figure 4:
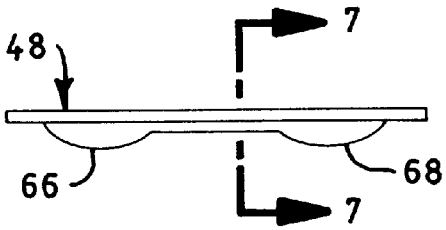
FIG. 4 is an end view of the shield of FIG. 1.
Figure 5:
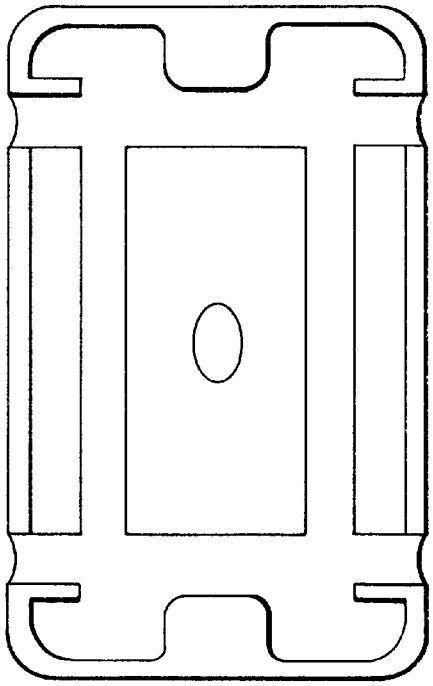
FIG. 5 is a back view of the shield of FIG. 1.
Figure 7:
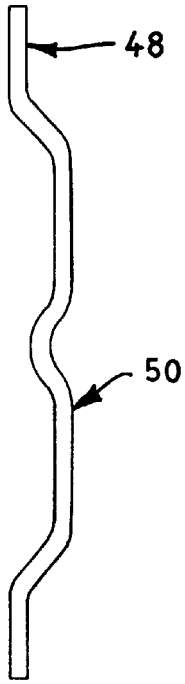
FIG. 7 is a cross-sectional view of FIG. 4, taken along the line 7—7 of FIG. 4.
Figure 6:
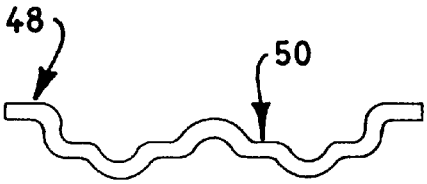
FIG. 6 is a cross-sectional view of FIG. 3 taken along the line 6—6 of FIG. 3.

FIG. 1 shows a standard electrical utility or outlet box 20 having a front opening 22, a back wall 24, and a peripheral wall 26 that has opposed vertical sections 28, 30 and opposed top and bottom sections 32, 34 that bound the back wall and the front opening. Outlet box 20 is affixed to a stud 21 by nails 23 and 25. Peripheral wall 26 has free front edges 27 of predetermined thickness, which may be considered to lie in a plane and to define a front profile having an inner perimeter 27*a* and an outer perimeter 27*b*. Peripheral wall 26 has a pair of inwardly directed ridges 36, 38 having forward faces that lie in the plane of free front edges 27 of the peripheral wall. These ridges have holes 40, 42 for the reception of screws by which a finish plate 44 may be secured to the front face of the outlet receptacle after its front opening 22 is exposed through the drywall.

A shield embodying the present invention is shown at 46. Geometrically, shield 46 is shaped like a tray having an outer rim section 48 that lies in an anterior plane, an inner base section 50 that lies in a posterior plane, and an intermediate slope section 52 between rim section 48 and base section 50. Rim section 48 has an outer perimeter 48*a* and an inner perimeter 48*b*. The front profile of rim section 48 surrounds the front profile of slope section 52. The front profile of slope section 52 surrounds the front profile of base section 50. The rim section and the slope section have a plurality of gaps 54, 56, 58, 60. A plurality of catches 62, 64, 66, 68 extend outwardly from base section 50 through the gaps. The profiles of the catches, shaped as claws, extend outwardly at least to the inner perimeter 48*b* of the front profile of rim section 48. The arrangement is such that the base of the shield can be pressed into the front opening of outlet receptacle 20, and held in position by the catches, which clutch the receptacle's interior walls. After use, the shield can be pried from the receptacle by a screwdriver for replacement by finish plate 44.

Figure 8:
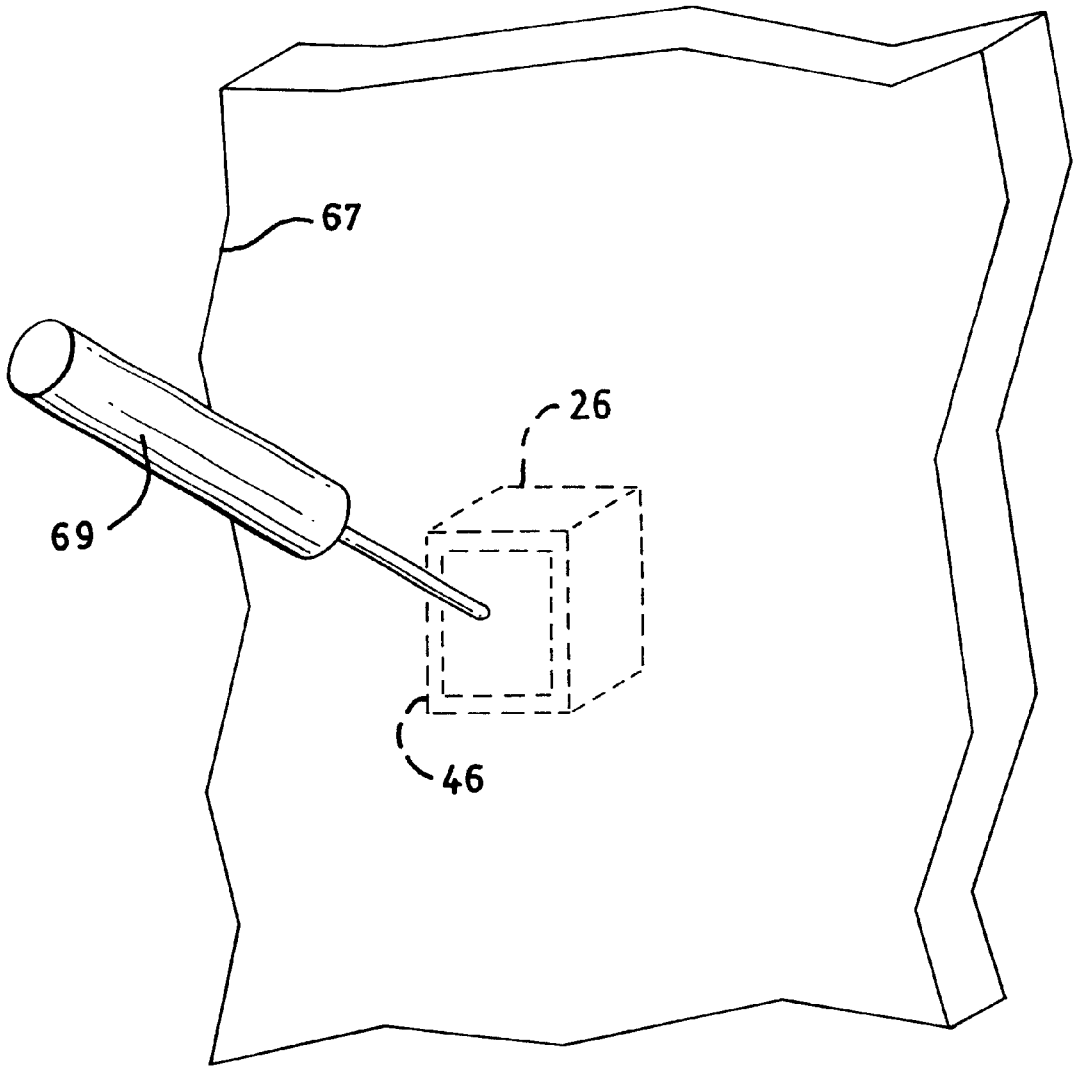
FIG. 8 shows a step in the use of the shield of FIG. 1.

Shield 46 is a thin sheet metal stamping, composed, for example, of 16 to 18 gauge mild steel. This construction and composition provides catches 62, 64, 66, 68 with a spring-like character that biases them against the inner surfaces of the outlet receptacle's walls when the shield is in use. A supply of stacked shields can be carried easily in a worker's pocket. FIG. 8 illustrates the use of shield 46, which is shown behind a drywall 67, operationally mounted on outlet box 26. The location of the shield 46, together with the location of the outlet box 26, is found in the conventional manner. For safety, a cutting drill 69 is guided carefully into contact with base section 50 of the shield, then into contact with slope section 52, then into contact with outer perimeter 48*a*, and then in contact with and around perimeter 48*a* to cut an opening in drywall 67.

Figure 9:
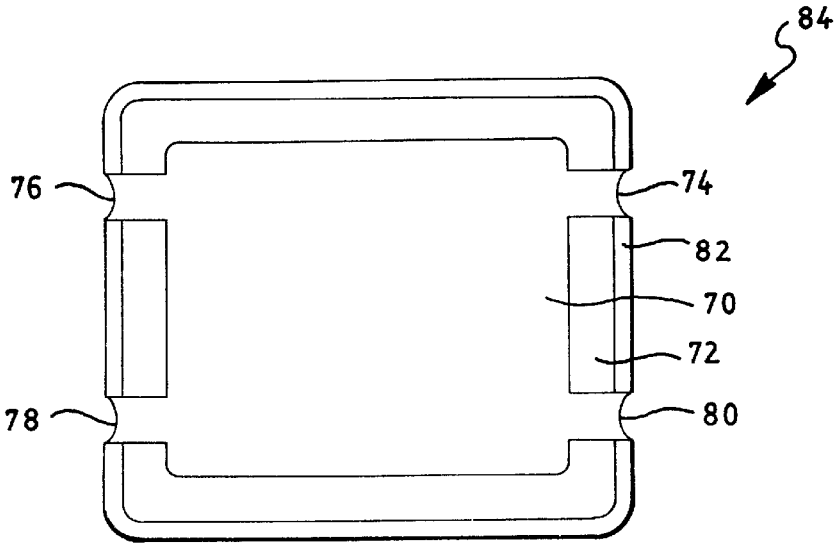
FIG. 9 shows a two-gang version of a shield embodying the present invention.

FIG. 9 illustrates a two-gang shield 84 having an outer rim section 82, an inner base section 70, an intermediate slope section 72 and four catches 74, 76, 78, 80. The structure and function of the components of two-gang shield 84 are analogous to the structure and function of the corresponding components of shield 46 of FIG. 1.

Figure 10:
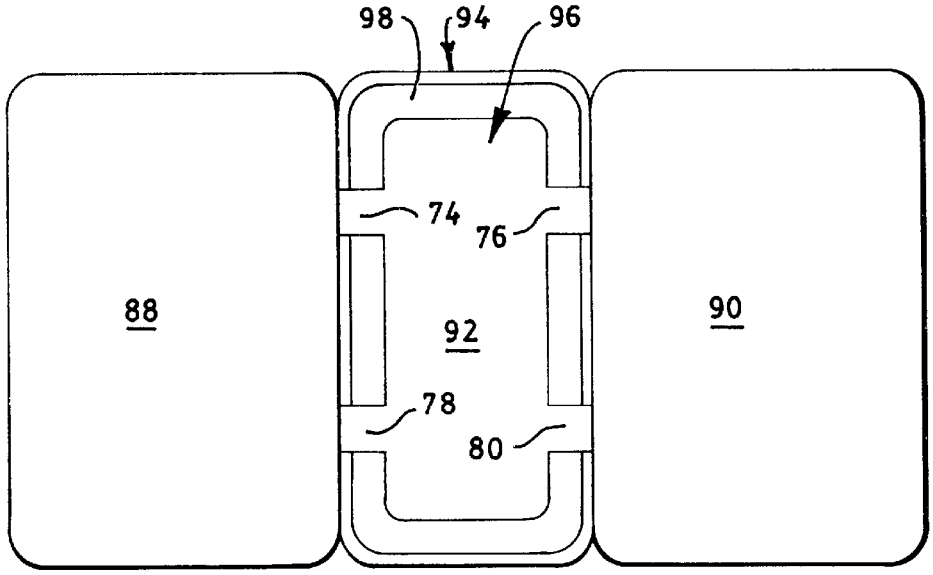
FIG. 10 shows a three-gang assemblage of shields embodying the present invention.

FIG. 10 illustrates a three-gang shield arrangement 86 comprising three shields 88, 90, 92. Each of shields 88 and 90 is identical to shield 46 of FIG. 1 in structure and function. Shield 92, however, is of slightly different construction and function. Shield 92 has an outer rim section 94, an inner base section 96, an intermediate slope section 98 and four catches 74, 76, 78, 80. Unlike the catches of shields 88, 90 which provide claws that turn forwardly, catches 74, 76, 78, 80 provide claws that turn rearwardly. The arrangement is such that, when shields 88, 90, 92 are assembled at the opening of a three-gang outlet receptacle, they are retained in part by the catches which clutch the opposite walls of the outlet receptacle, and in part by the claws of shield 92 and the claws of shields 88, 90, which engage each other in the manner of reversely oriented hooks.

Figure 11:
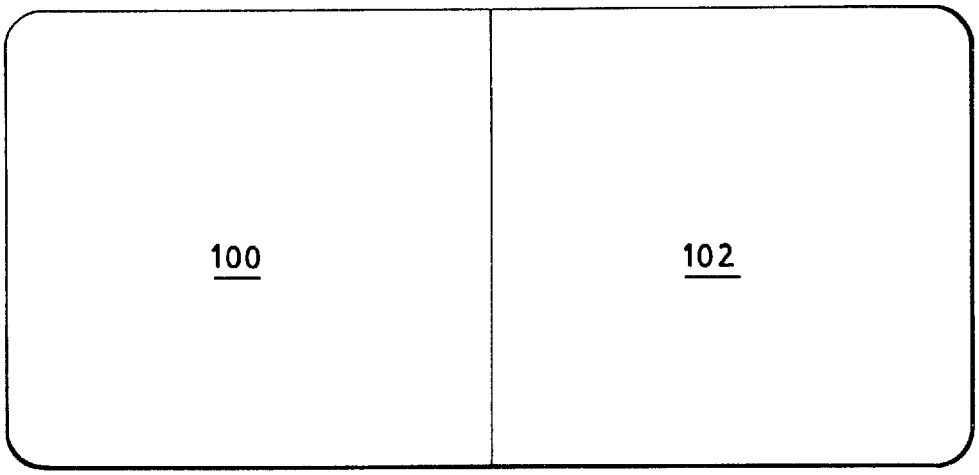
FIG. 11 shows a four-gang assemblage of shields embodying the present invention.

FIG. 11 illustrates a four-gang shield the comprises two two-gang shields 100, 102. Each of these shields is identical to the two-gang shield that is shown in FIG. 9. The arrangement is such that, when shields 100, 102 are assembled at the opening of a four-gang outlet receptacle, they are retained in part by the remote catches that clutch the opposite walls of the outlet receptacle, and in part by the adjacent catches that clutch each other.

Figure 12:
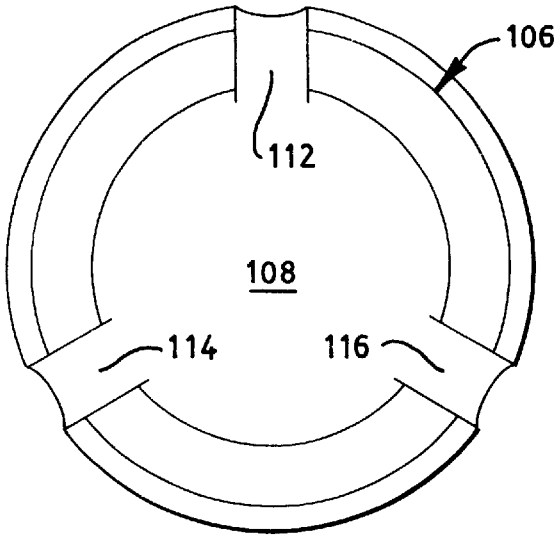
FIG. 12 shows a circular shield embodying the present invention.

FIG. 12 illustrates a circular shield 104 having an outer rim section 106, an inner base section 108, an intermediate slope section 110, and three catches 112, 114, 116. The arrangement is such that, when shield 104 is assembled with a cylindrical outlet receptacle, it is retained by the catches, which clutch the inner cylindrical walls of the outlet receptacle.

OPERATION

In operation, shield 46 is press fitted into an outlet receptacle 26, which is nailed to one of a series of wall studs. Shield 46 is retained in position by catches 62, 64, 66, 68 which clutch the inner surfaces of the walls of the outlet receptacle. Thereafter, a drywall 44 is nailed to the wall studs in front of outlet box 26. The location of the shield, together with the location of the outlet box, is detected. For safety, a cutting drill 68 is guided carefully into contact with base section 50 of the shield, then into contact with slope section 52, then into contact. with outer perimeter 48*a*, and finally in contact with and around outer perimeter 48*a* to cut an opening in drywall 66. A finish plate then is secured in position by screws, which are turned into holes 40, 42.

What is claimed is:

1. A shield adapted for temporarily covering a front opening of a utility receptacle that has a back wall and a peripheral wall bounding said back wall and said front opening, said peripheral wall having free front edges of predetermined thickness which lie in a plane and define a rim having an outer perimeter and an inner perimeter, said peripheral wall having a plurality of inwardly directed ridges having openings and forward faces that lie in the plane of said front edges of said peripheral wall, said shield being in the shape of a sheet metal stamping comprising:

(a) an outer rim section that lies in an anterior plane, said rim section having an outer perimeter and an inner perimeter;

(b) an inner base section that lies in a posterior plane; and (c) an intermediate slope section that lies between said rim section and said base section;

(d) the front profile of said rim section surrounding the front profile of said slope section and the front profile of said slope section surrounding the front profile of said base section;

(e) said rim section and said slope section having a plurality of gaps;

(f) a plurality of catches extending outwardly from said base section through said gaps;

(g) the outer extremities of said catches adapted to extend outwardly at least to the inner perimeter of said front profile of said rim section.

2. The shield of claim 1 wherein said profile of said outer rim section is rectangular.

3. The shield of claim 1 wherein said profile of said outer rim section is circular.

4. The shield of claim 1 wherein said shield is a stamping composed of 16 to 18 gauge mild steel.

* * * * *